343-872 SR
4/15/80 XR 4,198,639

United States Patent [19] [11] 4,198,639
Killion [45] Apr. 15, 1980

[54] PARABOLIC AND LOG PERIODIC ANTENNAS COMBINED FOR COMPACT HIGH-GAIN BROADBAND ANTENNA SYSTEM

[75] Inventor: Derling G. Killion, San Diego, Calif.

[73] Assignee: Cubic Corporation, San Diego, Calif.

[21] Appl. No.: 972,721

[22] Filed: Dec. 26, 1978

[51] Int. Cl.[2] ..... H01Q 21/00; H01Q 1/28
[52] U.S. Cl. ..... 343/727; 343/792.5; 343/840; 343/872
[58] Field of Search ..... 343/725, 727, 792.5, 343/705, 708, 840, 872

[56] References Cited

U.S. PATENT DOCUMENTS 2,820,965 1/1958 Sichak ..... 343/756

*Primary Examiner*—Eli Lieberman
*Attorney, Agent, or Firm*—Brown & Martin

[57] ABSTRACT

The disclosed antenna system includes a non-conductive parabolic dish, a first antenna array rigidly positioned in front of the dish, and a second antenna array extending through the dish and having radiating elements on either side thereof. In one embodiment, a plurality of conductive strips are disposed on the dish in a polarization selective pattern; the first antenna array generates linearly polarized electric fields that are reflected by the strips; and the second antenna array generates linearly polarized electric fields that pass through the strips. In another embodiment of the invention a plurality of conductive areas are disposed on the dish in a checkerboard frequency selective pattern; the first antenna array generates electric fields in a frequency band that are reflected by the pattern; and the second antenna array generates electric fields in a frequency band that are passed by the pattern.

10 Claims, 6 Drawing Figures

PARABOLIC AND LOG PERIODIC ANTENNAS COMBINED FOR COMPACT HIGH-GAIN BROADBAND ANTENNA SYSTEM

BACKGROUND OF THE INVENTION

This invention relates to antenna systems, and more particularly to antenna systems that in operation are enclosed in a radome that is mounted on an aircraft. Typically, in such systems the radome is mounted either on top of or underneath the aircraft; and the antenna system that is enclosed therein is rotated 360° in the horizontal plane to scan the horizon in all directions.

One problem encountered with the design of such systems is that of simultaneously meeting the conflicting requirements of a broad frequency band, a high gain, and a low drag on the aircraft. Basically, to increase the frequency band of an antenna array, the number of radiating elements must by increased. Thus, more space is required in the radome for these elements. The problem is most severe when the frequency range to be extended is at the low end of the band. This is because the size of a radiating element is roughly inversely proportional to the frequency being radiated.

Similarly, to improve the gain of an antenna array, a parabolic reflector may be used. In general, the gain increases as the size of the reflector is increased. However, a large reflector necessitates the use of a large radome, which in turn increases the drag on the airplane.

The drag caused by a radome is roughly proportional to the square of its cross-sectional area. Thus, it is highly desirable to minimize the radome's size.

Therefore, it is one object of the invention to provide an improved compact high-gain broadband antenna system for use within a radome of predetermined size.

SUMMARY OF THE INVENTION

This object and others are accomplished in accordance with the invention by an antenna system that includes a non-conductive parabolic dish, a first antenna array rigidly positioned in front of the dish, and a second antenna array extending through the dish and having radiating elements on either side thereof. One embodiment also includes a plurality of spaced apart conductive strips lying parallel to one another in one direction on the dish. In this embodiment, the first antenna array generates electric fields that are linearly polarized in the one direction; while the second antenna array generates electric fields that are linearly polarized perpendicular to the one direction. In operation, the conductive strips reflect the electric fields that are generated by the first antenna array, but pass the electric fields that are generated by the second antenna array. One other embodiment includes a checkerboard pattern of spaced apart conductive areas on the dish. The pattern acts as a frequency selective reflector; and the first antenna array generates electric fields in the reflection band, while the second antenna array generates electric fields outside of the reflection band.

BRIEF DESCRIPTION OF THE DRAWINGS

Various preferred embodiments of the invention will best be understood by reference to the following detailed description, and concurrent reference to the accompanying drawings, wherein.

DETAILED DESCRIPTION

Figure 1:
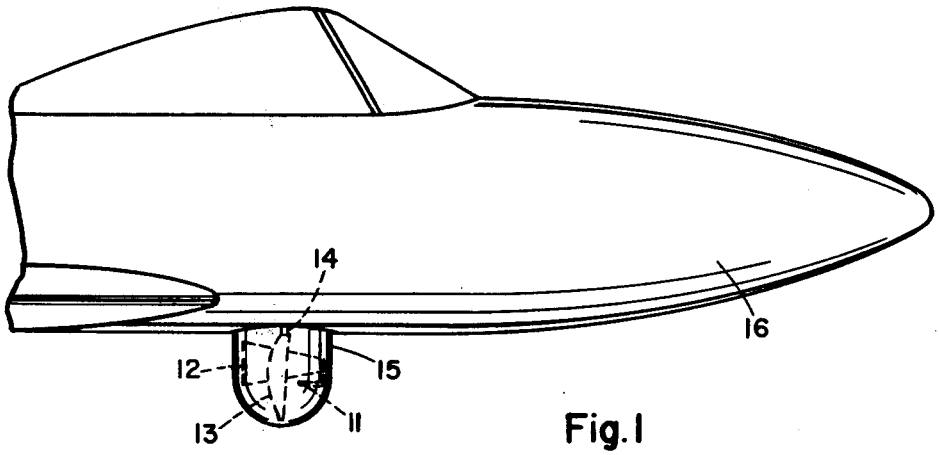
FIG. 1 is a pictorial view of the disclosed antenna system in its intended operating environment.

Referring to FIG. 1, there is illustrated a pictorial view of the disclosed antenna system in its operating environment. Basically, this antenna system includes a pair of antenna arrays 11 and 12, a parabolic refelctor 13, and a pivot arm 14. Components 11, 12, and 13 are rigidly interconnected in their positions relative to each other. In particular, array 12 passes part way through reflector 13 such that it has radiating elements on either side thereof; and array 11 mechanically attaches to array 12 and has all of its radiating elements in front of reflector 13.

Pivot arm 14 provides a means for rotating antenna arrays 11 and 12, and reflector 13 as a unit. This rotation occurs in the horizontal plane over a full 360°. Thus, the antenna arrays 11 and 12 are able to scan the horizon in any direction.

Components 11 through 14 are enclosed within a radome 15; and the radome in turn attaches to the surface of an aircraft 16. The radome must of course, be large enough to allow components 11 through 14 to rotate therein. On the other hand, it is desirable to make the radome small in order to reduce the drag on airplane 16. Basically, the disclosed invention allows both of these conflicting requirements to be met by providing an antenna system that sweeps a minimal volume for a given frequency band and gain requirement.

Figure 2:
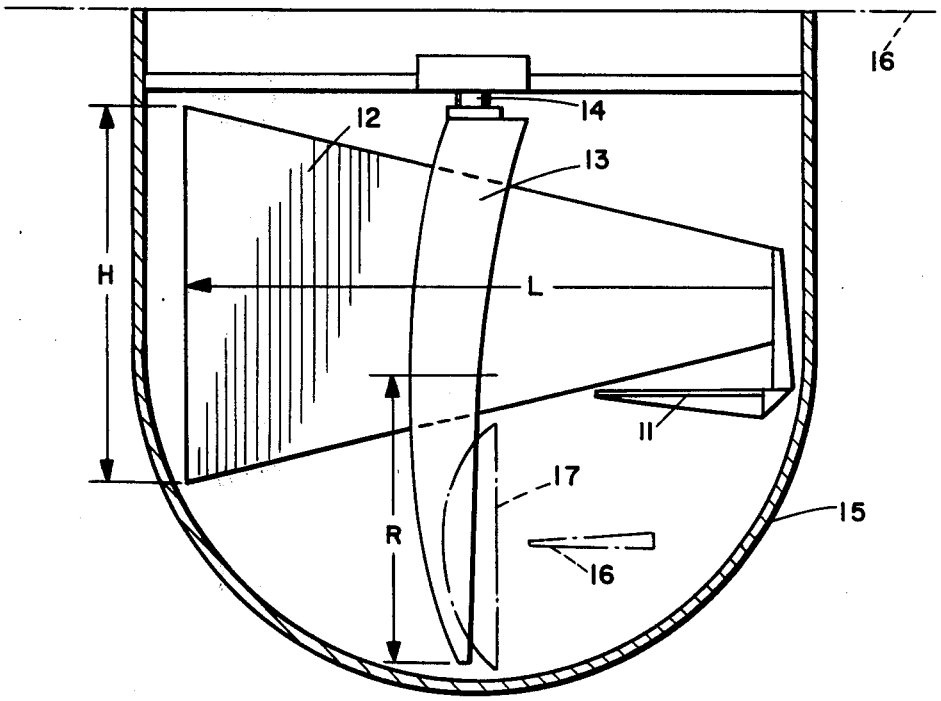
FIG. 2 is a detailed schematic diagram of the antenna system of FIG. 1.

This fact is more clearly illustrated by the schematic diagram of FIG. 2. There, antenna arrays 11 and 12 respectively provide the radiating elements for the high and low frequencies. Basically, as the low end of these frequencies are extended, the length L and height H of antenna 12 must also be extended. Further, as the gain requirements of the combination of reflector 13 and antenna 11 are increased, the radius of reflector 13 must also be increased.

In the prior art, antenna 12 did not pass through the reflector 13. Instead, components 12 and 13 were offset from one another such that they did not touch. Now in order to do this without decreasing the frequency spectrum of the antenna system and without increasing the size of the radome, reflector 13 must be shrunk in size and moved in position as indicated via reference numeral 18. Antenna 11 would also be moved as indicated via reference numeral 17. This however, clearly reduces the gain of the antenna system.

Alternatively, in the prior art the gain of the antenna system could be kept constant without increasing the size of the radome if the frequency spectrum was decreased. This was achieved by eliminating those radiating elements that lie behind reflector 13. This area is indicated via shading in FIG. 2. Elements in that area had to be eliminated in the prior art because reflector 13 was not frequency or polarization selective.

Figure 3:
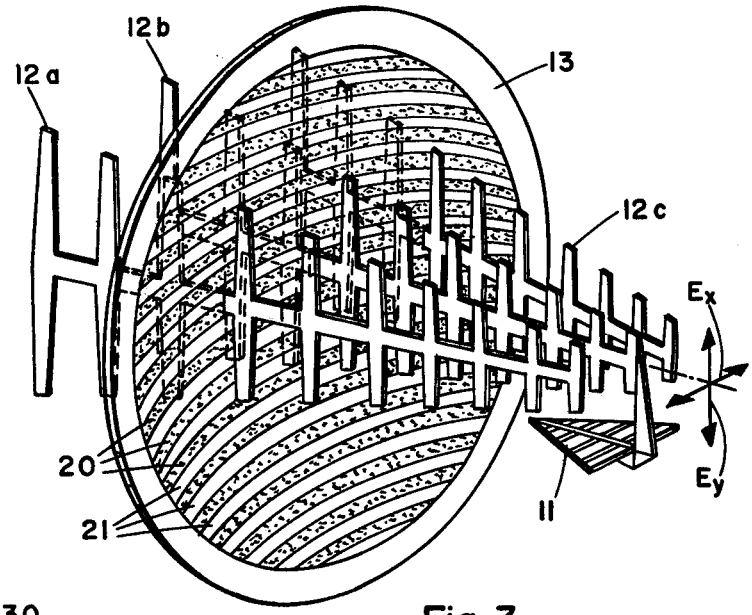
FIG. 3 is a pictorial view of the polarization selective embodiment of the antenna system in FIG. 1.

A detailed pictorial view of a polarization selective embodiment of the invention will now be described in conjunction with FIG. 3. In this embodiment a high frequency array 11*a* generates electric fields $E_X$ that are polarized in the horizontal direction; whereas low frequency arrays 12*a*, 12*b*, and 12*c* generate electric fields $E_Y$ that are polarized in the vertical direction.

A particular version of this embodiment that was actually constructed operated over the frequency range of 500 megahertz to 18 gigahertz. The smallest radiating element on array 11*a* was one-half wavelength at 18 gigahertz, whereas the largest radiating element equalled one-half wavelength at one gigahertz. Also, the smallest radiating element on arrays 12*a*–12*c* equalled one-half wavelength at two gigahertz; whereas the largest radiating element was one-half wavelength at 500 megahertz. Further, for array 11*a*$\tau$ equalled 0.80 and $\alpha$ equalled 30°; and for arrays 12*a*–12*c*, $\tau$ equalled 0.85 and $\alpha$ equalled 15°.

Preferably, the desired polarization selective refelction characteristics for reflector 13 are achieved by disposing a plurality of conductive strips 20 thereon. These strips lie spaced apart, parallel to one another, and parallel to the radiating elements of array 11*a*. Suitable reflection characteristics are achieved by making the edge-to-edge spacing 21 between the strips 20 less than one-half wavelength of the maximum frequency that is to be reflected; and by making the width of the strips less than or equal to the spacing 21.

In the above described system that was actually constructed, the conductive strips 20 and the spacings 21 were both approximately $\frac{1}{8}$ of an inch. Also in that system, reflector 13*a* had an elliptical perimeter with the major diameter and minor diameter respectively being approximately 23 inches and 19 inches. The ellipse was formed of a 0.2 inch thick fiberglass sheet. The conductive strips 20 were sprayed thereon with a silver paint. Masking tape covered the spaces 21. Alternatively, the conductive strips 20 could be formed by depositing metal over one surface of the dish and subsequently photo-etching the strips by standard photo-etching techniques.

Figure 4:
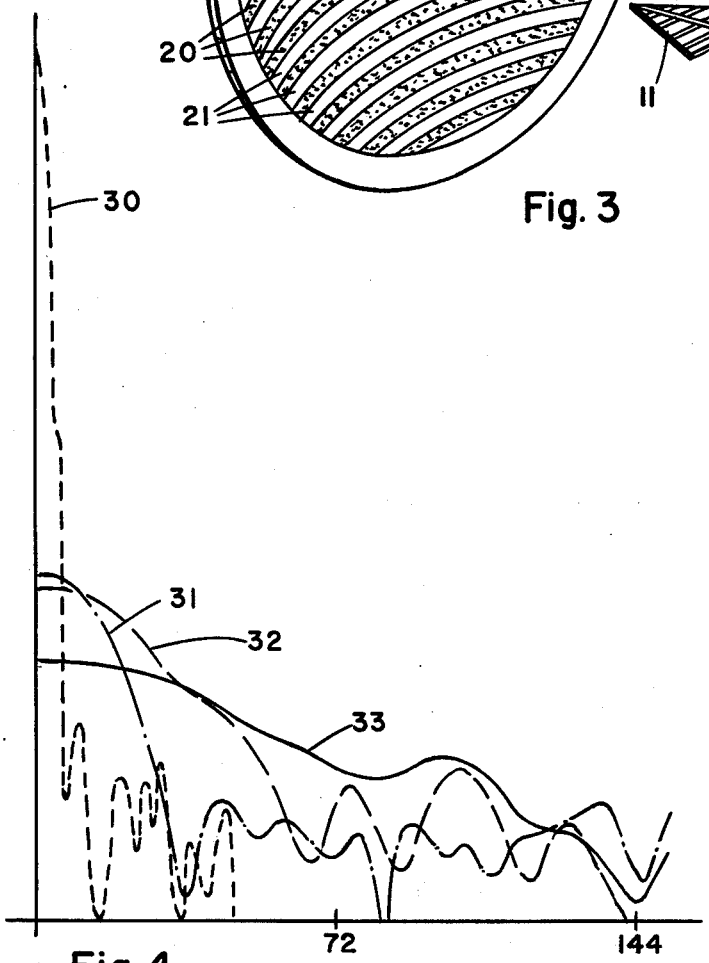
FIG. 4 is a set of curves illustrating the operation of the antenna system of FIG. 3.

A set of curves illustrating some test results of the antenna system that was constructed is given in FIG. 4. There, curves 30 and 31 illustrate the gain of array 11*a* at frequencies of 18 gigahertz and 1.5 gigahertz respectively. Also, curves 32 and 33 illustrate the gain of arrays 12*a*–12*c* at 1.5 gigahertz and 750 megahertz respectively. Of these two curves, the former is due to a radiating element in front of reflector 13*a* whereas the latter is due to a radiating element behind the reflector. Due to the transparency of reflector 13*a* to vertically polarized electric fields, the gain of the radiating element lying behind it remain substantially unchanged when the reflector is removed.

Figure 5:
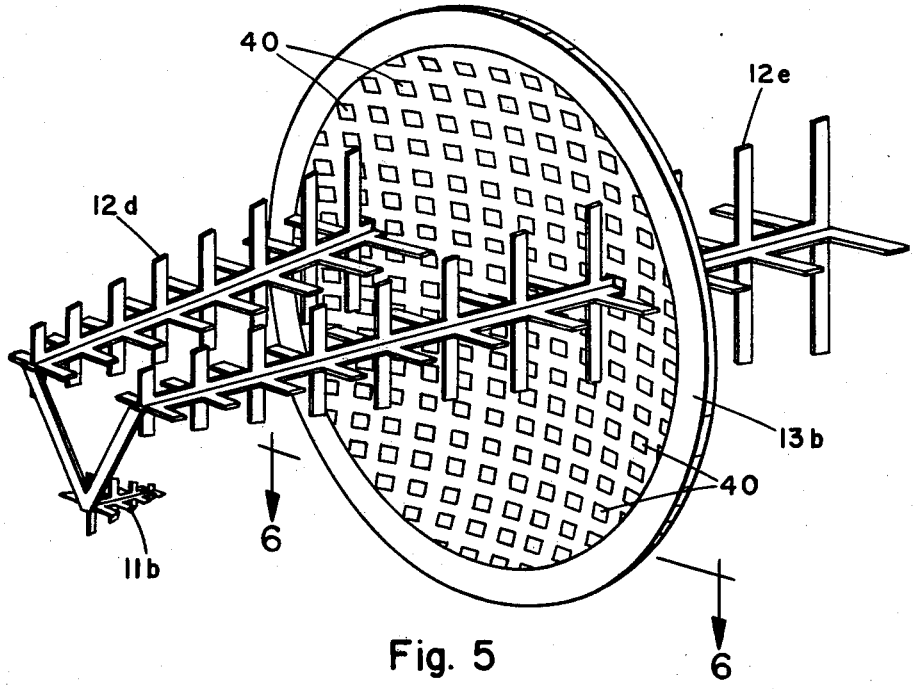
FIG. 5 is a pictorial view of a frequency selective embodiment of the antenna system of FIG. 1.

Another embodiment of the invention will now be described in conjunction with FIG. 5. Basically, this embodiment differs from the FIG. 3 embodiment in that it contains a reflector 13*b* that is frequency selective as opposed to being polarization selective. More specifically, reflector 13*b* is constructed to reflect electric fields that are generated by a high frequency antenna array 11*b* and to pass electric fields that are generated by the low frequency antenna arrays 12*d* and 12*e*.

The desired frequency reflection characteristics for reflector 13*b* is achieved by disposing a plurality of spaced apart conductive areas 40 on the surface of reflector 13*b*. These conductive areas may be of a variety of shapes. For example, they may be either square, rectangular, circular, or elliptical. A square shape causes reflector 13*b* to act as a low pass filter. This filter cuts off at the frequency whose wavelength is approximately two times the width of the conductive areas.

Such a low pass reflector may be considered to be the inverse of a high pass reflector that consists of a grid of conductive strips. A grid passes all frequencies higher than the frequency whose wavelength is approximately twice the width of the distance between the conductive strips. If the conductive strips are changed to non-conductive dielectric strips and the areas between the strips are made conductive, then the resulting arrangement will pass all frequencies whose wavelength is greater than twice the width of the conductive areas.

A detailed mathematical analysis of the reflection characteristics for a patterned array of rectangular conductive areas is made in the publication "Scattering By A Two Dimension Periodic Array Of Narrow Plates" Radio Science, Volume 2, Number 11, November 1967, pages 1347–1359. There, the reflected frequency are shown to lie within a frequency band that is the function of the length, width, and spacing of the rectangular conductive areas. The same method of analysis may also be applied to arrays of either circular or elliptical conductive areas. See for example, the publication "Analysis Of Metal Strip Delay Structure For Micro-Wave Lens". Journal Of Applied Physics, Volume 20, March 1949, pages 257–262. See also the publication "Micro-Wave Antenna Theory And Design", By S. Silver, McGraw-Hill, 1949.

Figure 6:
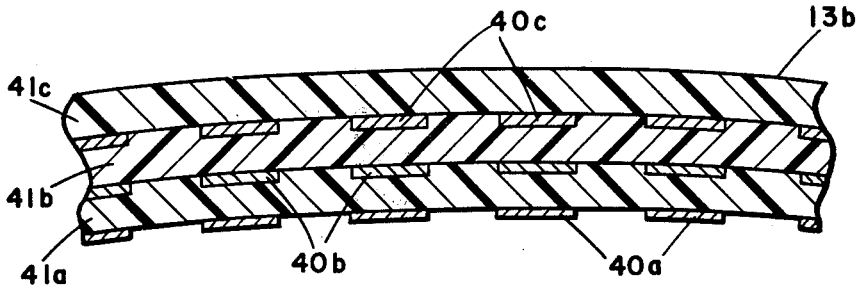
FIG. 6 is a cross-sectional view of the FIG. 5 embodiment.

All of the conductive areas 40 may lie on a single parabolic surface; or alternatively, they may lie on several parabolic surfaces that are sandwiched together. FIG. 6 is a cross-sectional view of the one sandwiched arrangement that contains three layers 40*a*, 40*b*, and 40*c* of the conductive areas. These areas are disposed on respective fiberglass surfaces 41*a*, 41*b*, and 41*c*. Preferably, the thickness of these layers is approximately one half wavelength of the maximum frequency to be reflected. Additional details of the relation between the thickness of the layers and the corresponding reflection frequency characteristics are given in the above cited reference entitled "Analysis Of The Metal Strip Delay Structure For Micro-Wave Lenses".

Various preferred embodiments of the invention have now been described in detail. In addition, many changes and modifications may be made thereto without departing from the nature and spirit of the invention. For example, in the polarization selective embodiment, any type of linear radiator (and not simply log periodic dipole) arrays can be used. Loop antenna arrays would be a suitable linear radiator for example. Also, the single high frequency antenna array 11*a* and 11*b* of FIGS. 3 and 5 may be replaced by a plurality of high frequency antenna arrays. Therefore, since many changes are possible, it is to be understood that the invention is not limited to said details but is defined by the appended claims.

I claim:

1. A compact antenna system for enclosure within a radome of predetermined size comprising;

a non-conductive parabolic dish;

first linear radiating means rigidly positioned in front of said dish for generating electric fields in a relatively high frequency band that are linearly polarized in one direction;

second linear radiating means extending through said dish and having radiating elements on either side thereof for generating electric fields in a relatively low frequency band that are linearly polarized perpendicular to said one direction; and polarization selective means on said dish for reflecting said electric fields that are linearly polarized in said one direction, and for passing said electric fields that are linearly polarized perpendicular to said one direction with substantially no reflection.

2. An antenna system according to claim 1 wherein said polarization selective means is comprised of a plurality of spaced apart conductive strips lying parallel to said one direction.

3. An antenna system according to claim 1 wherein said first linear radiating means is a single log period dipole array.

4. An antenna system according to claim 1 wherein said second linear radiating means is at least one log periodic dipole array.

5. An antenna system according to claim 1 wherein said relatively high frequency band and said relatively low frequency band overlap.

6. A compact antenna system for enclosure within a radome of predetermined size comprising:

a non-conductive parabolic dish;

first radiating means rigidly positioned in front of said dish for generating electric fields in one relatively high frequency band;

second radiating means extending through said dish and having radiating elements on either side thereof for generating electric fields in one relatively low frequency band outside of said high frequency band; and a patterned plurality of spaced apart conductive means on said dish for reflecting said electric fields in said high frequency band and for passing said electric fields in said low frequency band with substantially no reflection.

7. An antenna system according to claim 6 wherein said plurality of spaced conductive means are disposed on said dish in a checkerboard pattern.

8. An antenna system according to claim 7 wherein said conductive means of said plurality is square.

9. An antenna system according to claim 7 wherein each conductive means of said plurality is rectangular.

10. An antenna system according to claim 6 wherein said dish is comprised of laminated surfaces and said conductive means are disposed on more than one of said surfaces.

* * * * *